US007814841B2

(12) United States Patent
Hermant

(10) Patent No.: US 7,814,841 B2
(45) Date of Patent: Oct. 19, 2010

(54) RAKE OF RAIL CARS FOR PASSENGER TRANSPORT

(75) Inventor: Patrick Hermant, Nieul sur Mer (FR)

(73) Assignee: Alstom Transport SA, Levallois-Perret (FR)

( * ) Notice: Subject to any disclaimer, the term of this patent is extended or adjusted under 35 U.S.C. 154(b) by 59 days.

(21) Appl. No.: 12/074,957

(22) Filed: Mar. 7, 2008

(65) Prior Publication Data

US 2008/0216703 A1 Sep. 11, 2008

(30) Foreign Application Priority Data

Mar. 8, 2007 (FR) ..... 07 53731

(51) Int. Cl.
*B60D 5/00* (2006.01)

(52) U.S. Cl. ..... 105/8.1; 213/78

(58) Field of Classification Search ..... 105/4.1, 105/8.1, 159, 329.1; 213/75 R, 77, 78
See application file for complete search history.

(56) References Cited

U.S. PATENT DOCUMENTS

| | | | | |
|---|---|---|---|---|
| 1,435,198 | A * | 11/1922 | Bird | 105/8.1 |
| 4,067,261 | A * | 1/1978 | Scheffel | 105/168 |
| 5,261,330 | A | 11/1993 | Veit-Salomon et al. | 105/3 |
| 5,372,073 | A | 12/1994 | Cattani | 105/3 |
| 5,702,012 | A * | 12/1997 | Kanjo | 213/62 R |

FOREIGN PATENT DOCUMENTS

| | | |
|---|---|---|
| DE | 94 09 044 U1 | 11/1995 |
| DE | 295 18 297 U1 | 4/1997 |
| EP | 0 533 028 | 3/1993 |
| FR | 686 770 | 7/1930 |
| FR | 2 806 364 | 9/2001 |
| GB | 2 289 877 | 12/1995 |
| WO | WO 00/64721 | 11/2000 |

OTHER PUBLICATIONS

"Roll-out der Niederflur-Strassenbahn Combine", ZEV=DET Glas. Ann. 120 (1996) No. 8, August, pp. 348 and 349, XP 000627276.

* cited by examiner

*Primary Examiner*—S. Joseph Morano
*Assistant Examiner*—Zachary Kuhfuss
(74) *Attorney, Agent, or Firm*—Davidson, Davidson & Kappel, LLC

(57) ABSTRACT

A rake for use in trams and suburban vehicles comprising modules and single-articulation devices for connecting the modules, having an axis of rotation, or dual-articulation connection devices having two axes of rotation which are spaced-apart along the longitudinal line of the rake is disclosed.

The rake comprises at least two sub-assemblies of modules, the modules of which are mutually connected by means of single-articulation connection devices, each sub-assembly being connected to the or each adjacent sub-assembly by means of a dual-articulation connection device.

The rake comprises at least one sub-assembly of modules which comprises two carrier modules which are provided with supporting and guiding axles, and a module which has no axles and which is suspended between the carrier modules.

23 Claims, 3 Drawing Sheets

RAKE OF RAIL CARS FOR PASSENGER TRANSPORT

The invention relates to a rake of rail cars for passenger transport.

BACKGROUND

The present invention relates to a rake of rail cars for passenger transport and in particular a rake of tram cars or a suburban vehicle, the rake defining a travel plane and having two ends, the rake being of the type comprising:

rake modules which define passenger compartments and which are arranged in a row in a longitudinal line, the modules comprising carrier modules which are each provided with an assembly for support and guiding in a rail track, and connection devices which each connect two adjacent modules and which comprise single-articulation connection devices which each allow relative rotation of the modules which it connects about one axis which is substantially perpendicular relative to the travel plane of the rake, and at least one dual-articulation connection device which allows relative rotation of the modules which it connects about two axes which are substantially perpendicular relative to the travel plane of the rake and which are spaced-apart in a longitudinal manner, the rake comprising at least two sub-assemblies of modules, the modules of the same sub-assembly being mutually connected by means of single-articulation connection devices, each sub-assembly being connected to the or each adjacent sub-assembly by means of a dual-articulation connection device which connects adjacent carrier modules of these two sub-assemblies.

A tram of this type is known and marketed by the company SIEMENS under the name "Combino Plus", each sub-assembly of which is composed of two carrier modules which each have a body and a supporting and guiding bogie which is arranged longitudinally substantially at the centre of the module.

The presence of a dual-articulation connection device between two module sub-assemblies increases the number of degrees of freedom between the two sub-assemblies and allows the transverse forces supported by the rail track in bends to be limited in particular in bends having a small radius, such as in towns or suburban regions. This limits the wear of the wheels and provides good stability for the rake.

However, long bodies increase the kinematic spatial requirement (ground surface-area covered by the rake) of the rake in a bend, which has a detrimental effect with respect to its inclusion in urban traffic. For bodies having a large width, in the order of 2.6 m, it is necessary to reduce the width of the body at the longitudinal ends thereof in order to comply with the gauge.

This architecture does not offer satisfactory dynamic behaviour in bends and it was necessary to provide in the "Combino Plus" hydraulic systems for assisting the movements of the bodies of the modules relative to the bogies.

Furthermore, the bogies are remote from the ends of the bodies of the modules, between which the connection devices are arranged. This may bring about risks of the wheels of the bogies becoming unloaded and problems in terms of stability.

SUMMARY OF THE INVENTION

An object of the invention is to provide a rake of rail cars for passenger transport which has improved dynamic behaviour in bends and which has a limited kinematic spatial requirement.

To this end, the invention proposes a rake of rail cars for passenger transport of the above-mentioned type, characterised in that it comprises at least one sub-assembly of modules comprising two carrier modules and a carried module which has no supporting and guiding assembly and which is suspended between the carrier modules.

According to other embodiments, the rake comprises one or more of the following features, taken in isolation or according to any technically possible combination:

the rake is constituted by sub-assemblies which are formed by a carried module which is suspended between two carrier modules;

at least one dual-articulation connection device is formed by a coupling bar which is connected to each module by means of an articulation having an axis of one of the axes of the dual-articulation connection device;

each articulation uses means which form an articulation of the ball and socket type;

each supporting and guiding assembly has a single bogie;

each carrier module has a body, and the bogie of each carrier module is substantially fixed in terms of rotation relative to the body of the carrier module about an axis which is substantially perpendicular relative to the travel plane of the rake;

each carrier module has a body, and the bogie of each carrier module can be moved in terms of rotation relative to the body of the carrier module about an axis which is substantially perpendicular relative to the travel plane of the rake by means of a pivot-type connection between the bogie and the body or by means of a secondary suspension;

each carried module has at least one lateral access door;

the rake comprises two carrier modules which are each arranged at one end of the rake, each carrier module having at least one lateral face, and each carrier module being provided, at least one said lateral face, with a lateral access door;

the rake comprises two carrier modules which are each arranged at one end of the rake and which have no lateral access door;

the rake comprises at least three sub-assemblies;

the length of each carrier module is between 3 m and 7 m, preferably between 4 m and 6 m;

the length of each carried module is between 3 m and 9 m, preferably between 6 m and 8 m;

each carried module has at least one body end and each carrier module has at least one body end, and the longitudinal distance between a body end of each carried module and the body end of the adjacent carrier module is between 0.5 m and 1 m;

each module has a body end and the distance between the body ends of two modules which are connected by means of a dual-articulation connection device is between 1 m and 3 m, preferably between 1 m and 2 m;

the axial spacing between the axes of each dual-articulation connection device is between 1 m and 2 m, and is preferably approximately 1.5 m;

the rake comprises a passage between each pair of adjacent carrier modules which are connected by means of a dual-articulation connection device; and the rake comprises a passage between the carrier modules and the carried modules which are connected by means of a single-articulation connection device.

BRIEF DESCRIPTION OF THE DRAWINGS

The invention and the advantages thereof will be better understood from a reading of the following description, given purely by way of example, and with reference to the appended drawings, in which.

DETAILED DESCRIPTION

Figure 1:
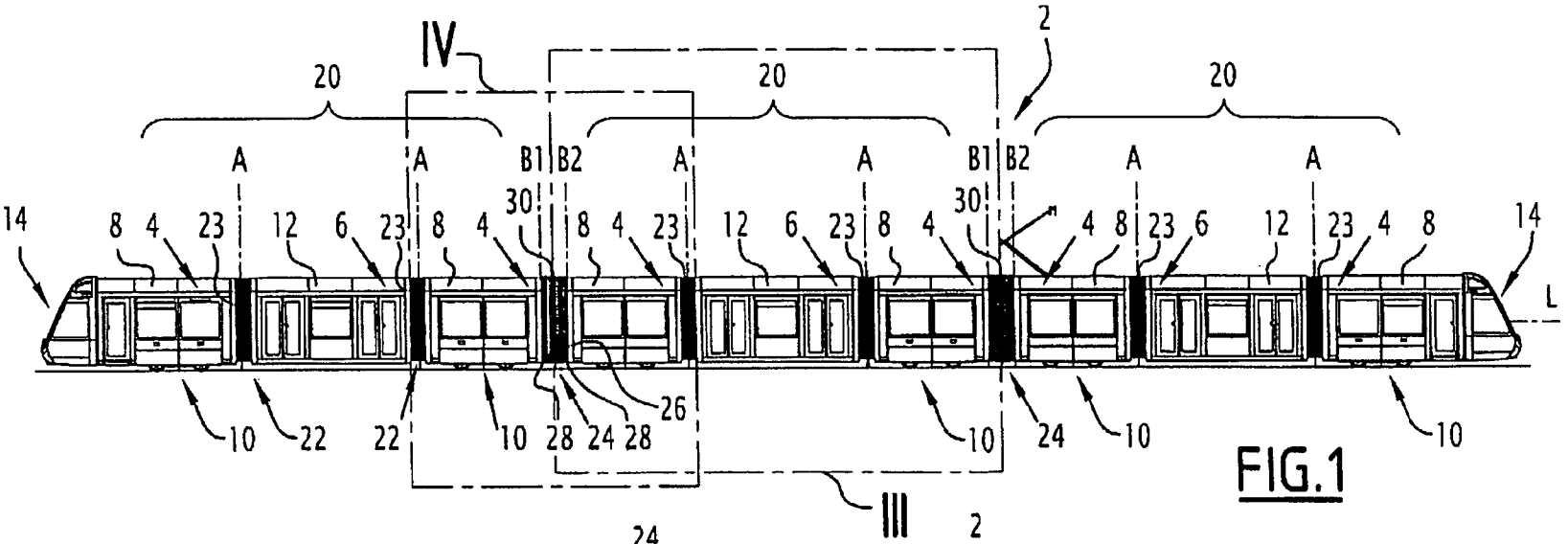
FIG. 1 is a side view of a tram according to the invention.
Figure 2:
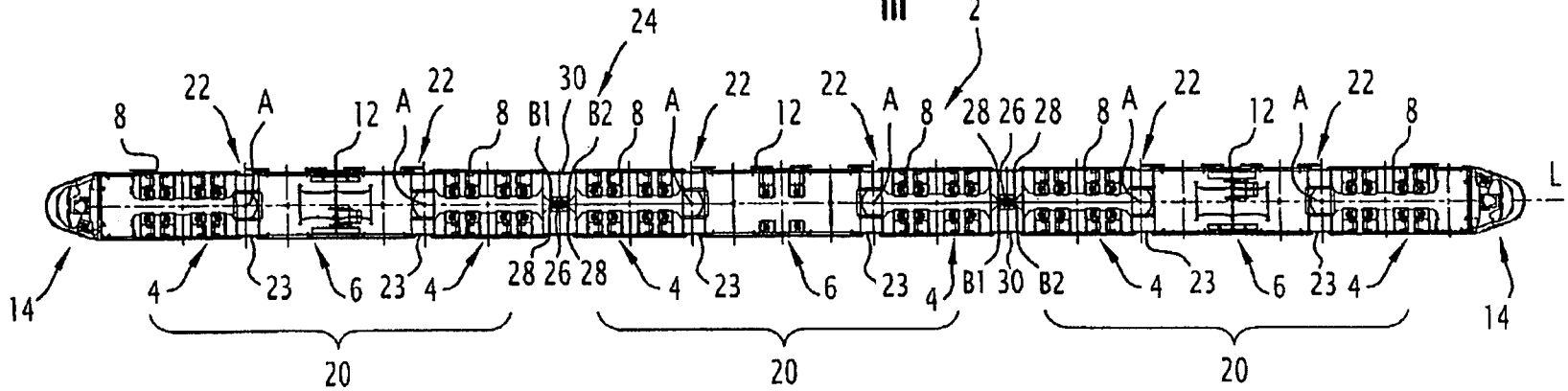
FIG. 2 is a plan view of the tram of FIG. 1 illustrating an interior arrangement.

As illustrated in FIGS. 1 and 2, the tram 2 is formed by modules 4, 6 which are arranged in a row along a longitudinal line L of the tram 2.

The modules 4, 6 are mutually connected in an articulated manner so that the line L follows the track on which the tram 2 is travelling. In straight lines, the line L is rectilinear and, in bends, the line L is curved.

Each module 4, 6 defines a passenger compartment.

The modules 4, 6 comprise carrier modules 4 and carried modules 6.

Each carrier module 4 has a body 8 and an assembly 10 for guiding and supporting the body 8 of the carrier module 4 in a rail track, for example, a dual-axle bogie.

Each carried module 6 has a body 12 and has no supporting and guiding assembly. Each carried module 6 is intended to be suspended in a manner known per se between two carrier modules 4.

In known manner, each body 8, 12 has a chassis, a roof, and two lateral faces.

The tram 2 further comprises two control cabins 14, which are each fixed to a carrier module 4 located at a longitudinal end of the tram 2. In a variant, the tram has only one cabin 14.

The two end carrier modules 4 are, for example, longer than the intermediate carrier modules 4 and each have, for example, on each of their two lateral faces, a lateral door which is arranged longitudinally between the bogie 10 and the cabin 14 which is fixed to this carrier module 4. In a variant, the end carrier modules 4 have the same length as the intermediate carrier modules 4.

A lateral door allows passengers to get on or off the tram. The other carrier modules 4 which are located in an intermediate position in the tram 2 have no lateral door. In another embodiment, the carrier modules 4 have at least one access door at least at one of the lateral faces thereof.

Each carried module 6 has, at one or each of the two lateral faces thereof, two doors which are longitudinally spaced-apart from each other. In another embodiment, each carried module 6 has, at one or each of the two lateral faces thereof, an access door. The modules 4, 6 are distributed in three sub-assemblies 20 of modules.

Each sub-assembly 20 comprises three modules, that is to say, two carrier modules 4 and a carried module 6 which is interposed between the carrier modules 4 and which is suspended therebetween.

The tram 2 has connection devices 22, 24 for connecting the modules 4, 6, each connection device 22, 24 connecting two adjacent modules 4, 6. Each connection device 22, 24 allows relative rotation of the two modules 4, 6 which it connects about at least one main axis which is substantially perpendicular relative to the travel plane of the tram 2 on a rail track, in order to allow travel in the bends of the rail track.

The travel plane of the tram 2 is the support plane for the wheels of the bogies 10 on the rails of a rail track. The travel plane coincides with the plane of the rail track when the tram 2 rests thereon.

The main axes of rotation of the connection devices 22, 24 are not necessarily strictly perpendicular relative to the travel plane owing to the possible small rotations of the bodies 8, 12 relative to the bogies 10, in particular in bends, owing to the clearances of the suspensions which are interposed in known manner between the bodies 8 and the bogies 10 thereof.

Figure 3:
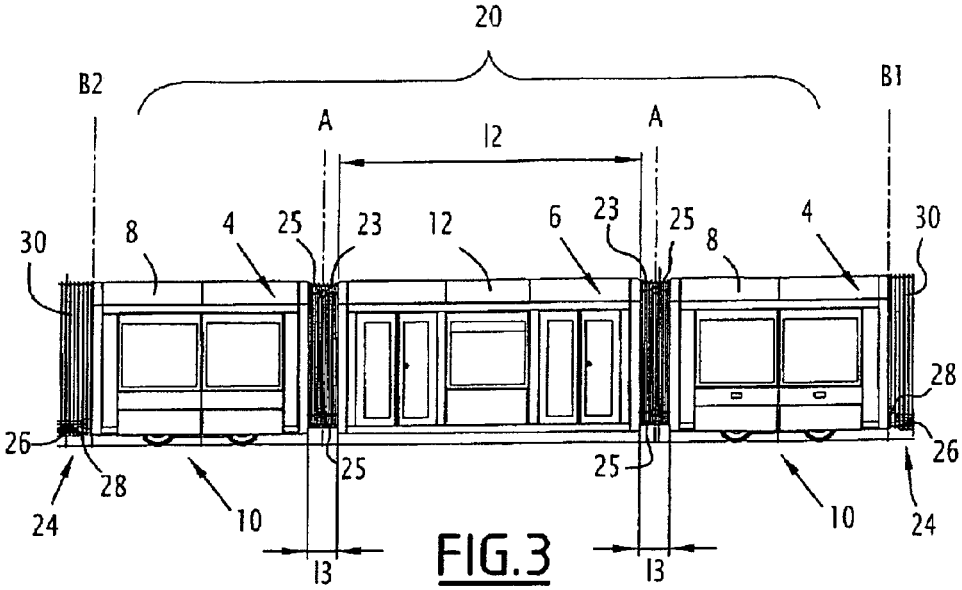
FIGS. 3 and 4 are enlarged views of the portions delimited by the zones III and IV in FIG. 1.

As illustrated in FIG. 3, in each sub-assembly 20, the carried module 6 is connected to each carrier module 4 by means of a single-articulation connection device 22 which has a single main axis of rotation A substantially perpendicular relative to the travel plane.

Each connection device 22 is, for example, produced from two ball and socket type joints 25 which are aligned along the axis A, thus defining a pivot having an axis A. A ball and socket type joint 25 connects the chassis bodies 8, 12 of the modules 4, 6 and a ball and socket type joint 25 connects the roofs of the bodies 8, 12. In a variant, the ball and socket type joints are replaced by any means which allows the production, between the bodies 8, 12, of a pivot connection having one degree of freedom, in terms of rotation about the axis A.

Each connection device 22 preferably has, in a manner known per se, connection members which limit and/or damp the relative angular clearances of the modules 4, 6.

In each sub-assembly 20, a passage 23, for example, a bellows-type passage, is interposed between the carried module 6 and each carrier module 4 in order to allow the passengers to move between the modules 4, 6.

Figure 4:
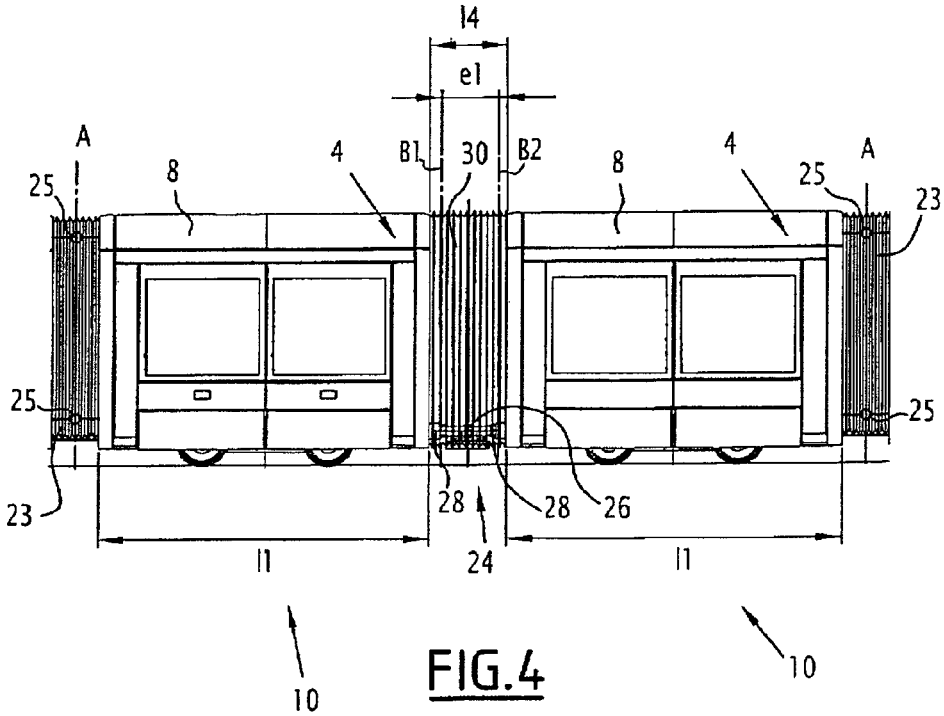

As illustrated in FIG. 4, each sub-assembly 20 is connected to the or each adjacent sub-assembly 20 by means of a dual-articulation connection device 24 which connects the adjacent carrier modules 4 of the two sub-assemblies 20.

Each connection device 24 has two main axes of rotation B1, B2 which are substantially perpendicular relative to the travel plane and which are longitudinally spaced-apart. Each connection device 24 comprises, for example, a coupling bar 26 which is connected at each of the ends thereof by means of a ball and socket type joint 28 to the chassis of one of the two carrier modules 4 which are connected by means of this connection device 24. The axes B1 and B2 each extend through the centre of a ball and socket type joint 28.

Each connection device 24 also allows rotations between the carrier modules 4 about longitudinal axes and transverse axes which extend through the centres of the ball and socket type joints 28, which facilitates the entry into bends and travel over depressions and bumps.

In a variant, the ball and socket type joints are replaced with any means which allow ball and socket type connections having three degrees of freedom in rotation to be produced between the bodies of the carrier modules 4.

The connection by means of a coupling bar at the lower portion (between the chassis) is, for example, supplemented, in known manner, at the lower or upper portion (between the roofs) by connection members which limit and/or damp the mutual angular clearances of the carrier modules 4.

A passage 30, for example, a bellows-type passage, is interposed between the adjacent carrier modules 4 of each pair of adjacent sub-assemblies 20 in order to allow passengers to move between these carrier modules 4. The passages 23 and 30 allow passengers to move inside the tram 2 over the entire length thereof.

Figure 5:
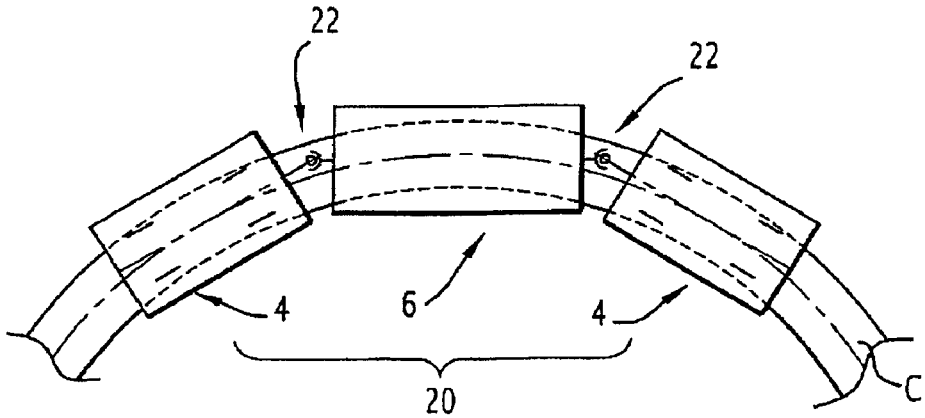
FIGS. 5 and 6 are schematic plan views of the portions of FIGS. 3 and 4, respectively, in a bend.
Figure 6:
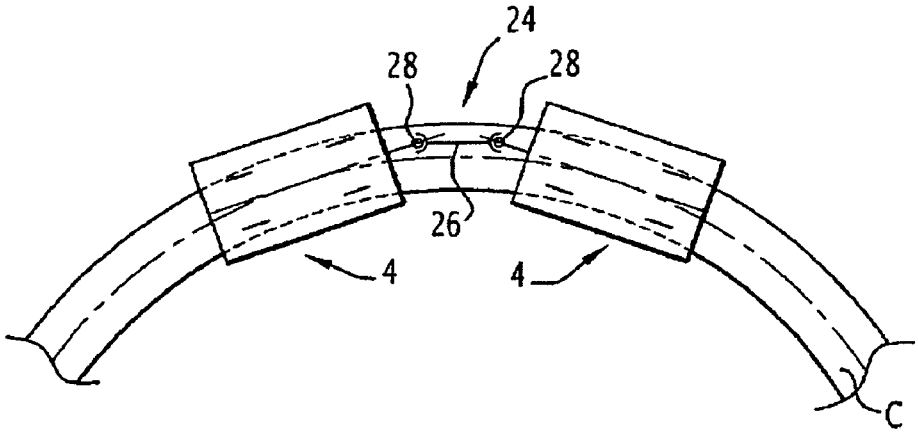

FIG. 5 is a plan view of a sub-assembly 20 in a bend, and FIG. 6 is a plan view of two adjacent carrier modules 4 of two different sub-assemblies 20 in a bend.

In a bend, two carrier modules 4 which are connected by means of a dual-articulation connection device 24 (FIG. 6) are able to pivot in the travel plane of the tram (plane of FIG. 6), providing good stability for the tram 2.

Since the dual-articulation connection devices 24 arranged between the sub-assemblies 20 comprise a greater number of degrees of freedom than the connection devices 22, they allow freer movements and reduce the dynamic problems of long rakes. Furthermore, the flexibility in the travel plane of each sub-assembly 20 is improved by the fact that a carried module 6 which has no bogie is interposed between two carrier modules 4.

Furthermore, it is possible to provide, in each sub-assembly 20, short carrier modules 4 which are in particular shorter than the carried module 6, which limits the kinematic spatial requirement of the tram 2, provides better holding for the tram 2 in bends and prevents the use of hydraulic systems to control the relative movements between the body and the bogie of each carrier module 4.

In each sub-assembly 20, the bogies 10 are arranged at the ends of the sub-assembly 20, below the modules 4 of limited length, so that a greater weight is applied to each bogie 10, which limits the risks of the wheels becoming unloaded and derailment and improves the stability of the rake.

As can be seen in FIG. 2, the body 8 of each carrier module 4 is provided in known manner with casings for receiving the wheels of the bogie which carries the body and to which it is possible to fix seats.

However, each module 6 does not have a bogie. It is therefore not necessary to provide casings of this type and the body 12 of each carried module 6 may therefore be provided with a substantially flat floor which has no walkway and which optionally has a wide ramp having an inclination of less than 10%. This facilitates access for passengers, allows zones to be provided for persons of limited mobility using a wheelchair and provides a large passenger capacity for each sub-assembly 20.

It is possible to provide a tram which is sufficiently long with a high passenger capacity whilst limiting the length of each module, which reduces the kinematic spatial requirement of the tram 2.

Advantageously, the modules 4, 6 and the connection devices 22, 24 comply with one or more of the following dimensions:

- the length 11 (FIG. 4) of each carrier module 4 is between 3 m and 7 m, preferably between 4 m and 6 m;
- the length 12 (FIG. 3) of each carried module 6 is between 3 m and 9 m, preferably between 6 m and 8 m;
- the distance 13 (FIG. 3) between a body end of each carried module 6 and the body end of the adjacent carrier module 4 is between 0.5 m and 1 m;
- the distance 14 (FIG. 4) between the body ends of two modules 4 which are connected by means of a dual-articulation connection device 24 is between 1 m and 3 m, preferably between 1 m and 2 m; and
- the axial spacing e1 (FIG. 4) between the axes B1 and B2 of each connection device 24 is between 1 m and 2 m, and is preferably approximately 1.5 m.

Compliance with these dimensions ensures simple use in bends, satisfactory dynamic behaviour in bends and prevents the wheels of the axles from becoming unloaded.

Furthermore, it is possible to provide bogies 10 which are non-orientable, that is to say, which are substantially fixed in terms of rotation relative to the body 8 of the carrier module 4 that it supports, about the direction perpendicular to the travel plane of the tram 2 on a rail track. The secondary suspension which is arranged in known manner between the bogie and the body will nonetheless allow a slight angular clearance of the body relative to the bogie, about an axis perpendicular relative to the travel plane and also about a longitudinal axis and/or a transverse axis. However, these angular clearances are limited and in particular the angular clearance about the axis perpendicular relative to the travel plane is, for example, between 1° and 3° at each side of a rest position and preferably between 1° and 2° at each side of the rest position. The use of non-orientable bogies simplifies the design of the tram and reduces the production cost thereof.

In another embodiment, orientable bogies 10 are provided, each bogie 10 being connected to the corresponding body 8 by means of a pivot connection having an axis perpendicular relative to the travel plane so as to be able to be moved in rotation about the pivot connection axis and perpendicularly relative to the plane. However, the angular clearances about the axis formed by the pivot are limited and between, for example, 1° and 3° at each side of a rest position and preferably between 1° and 2° at each side of the rest position.

The length of the tram is selected by selecting a corresponding number of sub-assemblies 20. A long tram, for example, of a length greater than 40 m, for example, substantially equal to 50 m, may be obtained whilst limiting the transverse forces supported by the rail track in bends, with satisfactory dynamic behaviour being obtained in bends and with the risks of the wheels becoming unloaded being limited.

The invention is used for trams which are intended to travel in towns and also for a rake of rail cars referred to as the "tram-train", which are intended to travel in towns and in suburban regions, moving from an urban rail track to an interurban rail track which are mutually connected.

What is claimed is:

1. A rake of rail cars for passenger transport, the rake defining a travel plane and having two ends, the rake comprising:

rake modules defining passenger compartments and being arranged in a row in a longitudinal line, the rake modules comprising carrier modules each provided with an assembly for support and guiding in a rail track, and connection devices each connecting two adjacent rake modules and comprising single-articulation connection devices each allowing relative rotation of the rake modules which the single-articulation connection device connects about one axis substantially perpendicular relative to the travel plane of the rake, and at least one dual-articulation connection device allowing relative rotation of the rake modules which the dual-articulation connection device connects about two axes substantially perpendicular relative to the travel plane of the rake, the two axes being spaced-apart in a longitudinal manner by an axial spacing, the rake defining at least two sub-assemblies of rake modules, the rake modules of a same sub-assembly being mutually connected by the single-articulation connection devices, each sub-assembly being connected to the or each adjacent sub-assembly by the dual-articulation connection device, the axial spacing being less than a distance between body ends of the two subassemblies connected by the dual articulation connection device, at least one of the sub-assemblies of rake modules comprising two carrier modules and a carried module without a supporting and guiding assembly and suspended between the carrier modules, a passage between each pair of adjacent carrier modules connected by the dual-articulation connection device, the passage allowing passengers to move between the carrier modules.

2. The rake according to claim 1 wherein the rake is constituted by sub-assemblies which are formed by a carried module which is suspended between two carrier modules.

3. The rake according to claim 1 wherein the at least one dual-articulation connection device is formed by a coupling bar connected to each rake module by an articulation having an axis of one of the axes of the dual-articulation connection device.

4. The rake according to claim 2 wherein the at least one dual-articulation connection device is formed by a coupling bar connected to each rake module by an articulation having an axis of one of the axes of the dual-articulation connection device.

5. The rake according to claim 3 wherein each articulation includes a ball and socket articulation.

6. The rake according to claim 1 wherein each supporting and guiding assembly has a single bogie.

7. The rake according to claim 6 wherein each carrier module has a body, and the bogie of each carrier module is substantially fixed in terms of rotation relative to the body of the carrier module about an axis which is substantially perpendicular relative to the travel plane of the rake.

8. The rake according to claim 6 wherein each carrier module has a body, and the bogie of each carrier module can be moved in terms of rotation relative to the body of the carrier module about an axis which is substantially perpendicular relative to the travel plane of the rake by a pivot-type connection between the bogie and the body or by a secondary suspension.

9. The rake according to claim 1 wherein each carried module has at least one lateral access door.

10. The rake according to claim 1 wherein the rake comprises two carrier modules each arranged at one end of the rake, each carrier module having at least one lateral face, and each carrier module being provided at at least one said lateral face, with a lateral access door.

11. The rake according to claim 1 wherein the rake comprises two carrier modules which are each arranged at one end of the rake without a lateral access door.

12. The rake according to claim 1 wherein the rake comprises at least three sub-assemblies.

13. The rake according to claim 1 wherein the length of each carrier module is between 3 m and 7 m.

14. The rake according to claim 13 wherein the length of each carrier module is between 4 m and 6 m.

15. The rake according to claim 1 wherein the length of each carried module is between 3 m and 9 m.

16. The rake according to claim 15 wherein the length of each carried module is between 6 m and 8 m.

17. The rake according to claim 1 wherein each carried module has at least one body end and each carrier module has at least one body end, wherein the longitudinal distance between each body end of each carried module and the body end of the adjacent carrier module is between 0.5 m and 1 m.

18. The rake according to claim 1 wherein each rake module has a body end and the distance between the body ends of two rake modules connected by a dual-articulation connection device is between 1 m and 3 m.

19. The rake according to claim 18 wherein the distance between the body ends of two rake modules connected by a dual-articulation connection device is between 1 m and 2 m.

20. The rake according to claim 1 wherein the axial spacing between the two axes substantially perpendicular relative to the travel plane of the rake of each dual-articulation connection device is between 1 m and 2 m.

21. The rake according to claim 20 wherein the axial spacing between the two axes substantially perpendicular relative to the travel plane of the rake of each dual-articulation connection device is approximately 1.5 m.

22. The rake according to claim 1 wherein the rake comprises a passage between the carrier modules and the carried modules connected by a single-articulation connection device.

23. The rake according to claim 1 wherein, in the at least one sub-assembly of modules comprising two carrier modules and a carried module suspended between the carrier modules, the carrier modules are shorter than the carried module.

* * * * *